US009860623B1

(12) United States Patent
Lee et al.

(10) Patent No.: US 9,860,623 B1
(45) Date of Patent: Jan. 2, 2018

(54) STACKED CHIP MICROPHONE

(71) Applicant: Knowles Electronics, LLC, Itasca, IL (US)

(72) Inventors: Sung B. Lee, Chicago, IL (US); Wade Conklin, Chicago, IL (US); Michael Kuntzman, Chicago, IL (US); Sandra Vos, East Dundee, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 15/208,961

(22) Filed: Jul. 13, 2016

(51) Int. Cl.

| | |
|---|---|
| ***H04R 1/04*** | (2006.01) |
| ***H04R 3/00*** | (2006.01) |
| ***H04R 19/00*** | (2006.01) |
| ***H04R 19/04*** | (2006.01) |

(52) U.S. Cl.
CPC ..... *H04R 1/04* (2013.01); *H04R 3/00* (2013.01); *H04R 19/005* (2013.01); *H04R 19/04* (2013.01); *H04R 2201/003* (2013.01)

(58) Field of Classification Search
CPC ..... H04R 19/005; H04R 19/04; H04R 2201/003; H04R 2201/02; H04R 1/02; H04R 1/04; H04R 1/06; H04R 1/021; H04R 1/2892; H04R 31/003; H04R 3/00; H04R 3/007; H04R 17/00; H04R 2410/00
See application file for complete search history.

(56) References Cited

U.S. PATENT DOCUMENTS

| | | | | |
|---|---|---|---|---|
| 7,190,038 | B2 | 3/2007 | Dehe et al. | |
| 7,473,572 | B2 | 1/2009 | Dehe et al. | |
| 7,781,249 | B2 | 8/2010 | Laming et al. | |
| 7,795,695 | B2 | 9/2010 | Weigold et al. | |
| 7,825,484 | B2 | 11/2010 | Martin et al. | |
| 7,829,961 | B2 | 11/2010 | Hsiao | |
| 7,856,804 | B2 | 12/2010 | Laming et al. | |
| 7,903,831 | B2 | 3/2011 | Song | |
| 8,433,084 | B2 * | 4/2013 | Conti | B81B 7/0061 381/174 |
| 2005/0207605 | A1 | 9/2005 | Dehe et al. | |
| 2007/0278501 | A1 | 12/2007 | Macpherson et al. | |
| 2008/0175425 | A1 | 7/2008 | Roberts et al. | |
| 2008/0267431 | A1 | 10/2008 | Leidl et al. | |
| 2008/0279407 | A1 | 11/2008 | Pahl | |
| 2008/0283942 | A1 | 11/2008 | Huang et al. | |
| 2009/0001553 | A1 | 1/2009 | Pahl et al. | |
| 2009/0180655 | A1 | 7/2009 | Tien et al. | |
| 2010/0046780 | A1 | 2/2010 | Song | |
| 2010/0052082 | A1 | 3/2010 | Lee et al. | |
| 2010/0128914 | A1 | 5/2010 | Khenkin | |
| 2010/0183181 | A1 | 7/2010 | Wang | |

(Continued)

*Primary Examiner* — Thang Tran
(74) *Attorney, Agent, or Firm* — Foley & Lardner LLP

(57) ABSTRACT

A microphone device comprises a base, a port formed in the base, a cover attached to the base that forms a housing interior with the base, an MEMS element disposed in the housing interior and on top of the port, and an integrated circuit stacked on top of the MEMS element. The MEMS element includes a diaphragm and a backplate opposing the diaphragm. The integrated circuit includes an active surface and a substrate supporting the active surface. Circuitry and/or connectors are formed on the active surface for processing signals produced by the MEMS element. The substrate faces the MEMS element.

16 Claims, 4 Drawing Sheets

(56) References Cited

U.S. PATENT DOCUMENTS

| | | | | |
|---|---|---|---|---|
| 2010/0246877 | A1 | 9/2010 | Wang et al. | |
| 2010/0290644 | A1 | 11/2010 | Wu et al. | |
| 2010/0322443 | A1 | 12/2010 | Wu et al. | |
| 2010/0322451 | A1 | 12/2010 | Wu et al. | |
| 2011/0013787 | A1 | 1/2011 | Chang | |
| 2011/0075875 | A1 | 3/2011 | Wu et al. | |
| 2011/0293126 | A1* | 12/2011 | Maekawa | H04R 19/005 381/355 |
| 2012/0027234 | A1* | 2/2012 | Goida | H04R 1/04 381/150 |
| 2013/0032936 | A1* | 2/2013 | Formosa | H04R 31/00 257/704 |
| 2013/0195284 | A1* | 8/2013 | Yang | B81B 7/0061 381/91 |
| 2014/0037120 | A1* | 2/2014 | Lim | H04R 23/00 381/355 |
| 2014/0291785 | A1* | 10/2014 | Kasai | H04R 19/005 257/416 |
| 2014/0306299 | A1* | 10/2014 | Kasai | B81B 3/0027 257/416 |

* cited by examiner

STACKED CHIP MICROPHONE

BACKGROUND

The following description is provided to assist the understanding of the reader. None of the information provided or references cited is admitted to be prior art.

Miniaturized silicon microphones, also known as micro-electro-mechanical system (MEMS) microphones, have been extensively used in various electronic devices, such as smartphones, portable computers, tablets, hearing aids, etc. Typically, a MEMS element is housed in a package with an associated reading electronics, generally provided as an application specific integrated circuit (ASIC) chip. Although the package needs to be large enough to house both the MEMS element and the IC chip, reduced footprint of the package is desired.

SUMMARY

In general, one aspect of the subject matter described in this specification can be embodied in a microphone device. The microphone device comprises a base, a port formed in the base, a cover attached to the base that forms a housing interior with the base, an MEMS element disposed in the housing interior and on top of the port, and an integrated circuit stacked on top of the MEMS element. The MEMS element includes a diaphragm and a backplate located opposite to the diaphragm. The integrated circuit includes an active surface and a substrate supporting the active surface. Circuitry and/or connectors can be formed on the active surface for processing signals produced by the MEMS element. The substrate faces the MEMS element.

Another aspect of the subject matter can be embodied in a microphone device. The microphone device comprises a base, a port formed in the base, a cover attached to the base that forms a housing interior with the base, and an MEMS element disposed in the housing interior and on top of the port. The microphone element includes a diaphragm and a backplate located opposite to the diaphragm. The MEMS element is attached to the base through first solder bumps. The microphone device further comprises an integrated circuit stacked on top of the MEMS element through second solder bumps.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

Figure 1:
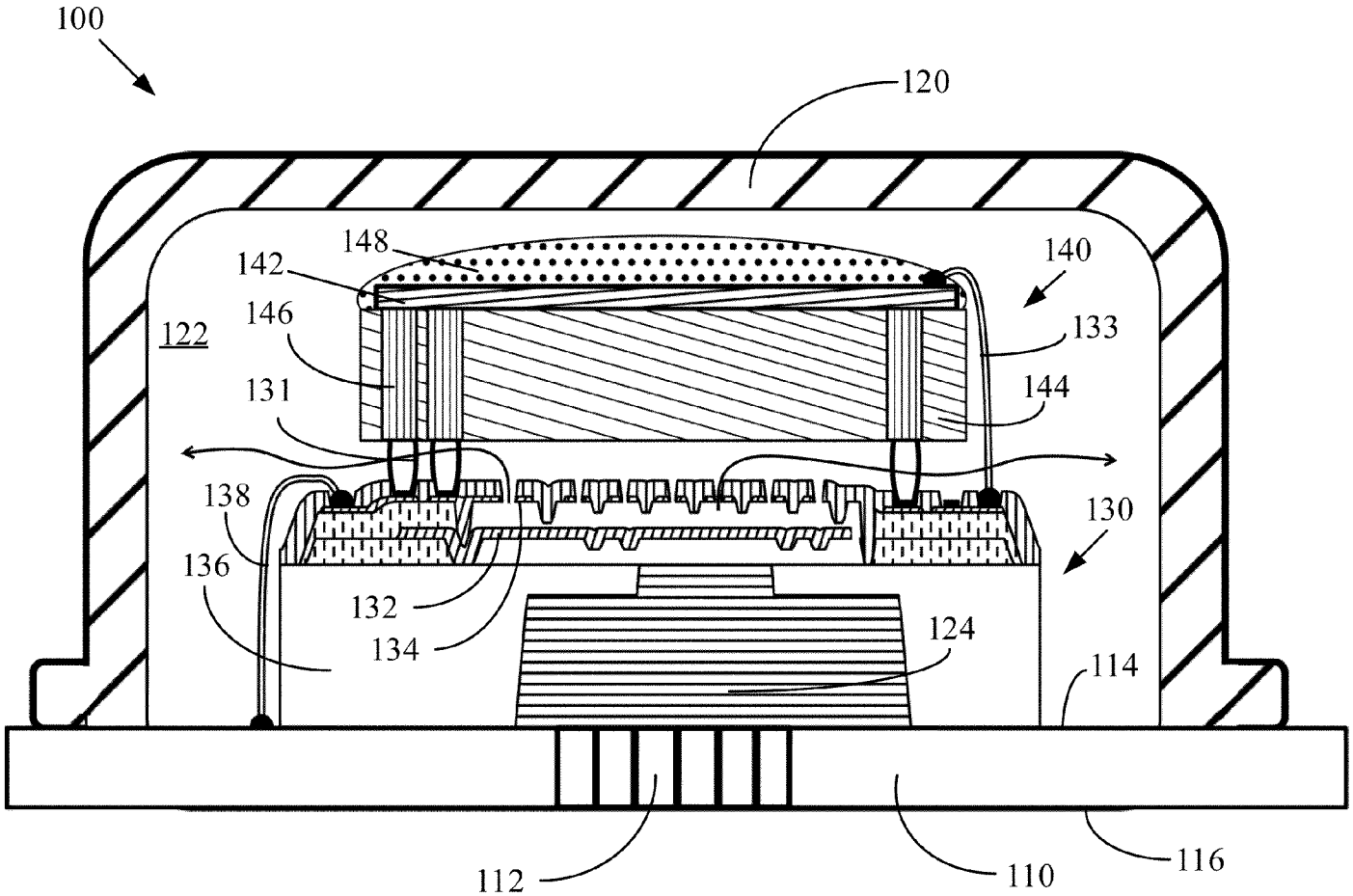
FIG. 1 is a schematic cross-sectional diagram of a stacked chip microphone device in accordance with a first embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

DETAILED DESCRIPTION

Referring to the figures generally, various embodiments disclosed herein relate to stacked chip microphone devices, i.e., an integrated circuit is stacked on top of a MEMS element in a package. A MEMS microphone device generally comprises an acoustic transducer, also known as a MEMS element for transducing acoustic pressure waves into an electrical value, and a reading element, for example as an ASIC for processing the electrical value and providing an electrical signal (e.g., a voltage). Comparing to the arrangement in which the MEMS element and the ASIC are placed side-by-side in a package, the stacked chip microphone devices disclosed herein can reduce the lateral space inside the package, thereby reducing the footprint of the package. The integrated circuit includes an active surface with circuitry and/or connectors formed thereon and a substrate supporting the active surface. In some embodiments, the substrate faces the MEMS element. This arrangement allows minimal exposure of the active surface to light that might pass through the MEMS element. In some embodiments, no wire bonding is used in the microphone device—the MEMS element is attached to the integrated circuit and to the base of the package through solder bumps. As no wire bonding is used on the MEMS element and the integrated circuit, a larger area can be used for active components of the MEMS element and the integrated circuit.

Referring to FIG. 1, a schematic cross-sectional diagram of a stacked chip microphone device is shown in accordance with a first embodiment. The microphone device 100 includes a base 110, a cover (or lid) 120, a MEMS element 130, and an integrated circuit 140. The cover 120 is attached to the base 110 and forms a housing interior 122 with the base 110. A port 112 is formed in the base 110, allowing sound to enter a front volume 124. The microphone element 130 is disposed within the housing interior 122 and attached to the base 110. The integrated circuit 140 is stacked on top of the MEMS element 130.

The base 110 may be a printed circuit board (PCB) formed of, for example, a solder mask layer, a metal layer, and an inner PCB layer (e.g., constructed of FR-4 material). In some embodiments, the base 110 includes alternating layers of conductive material (e.g., copper) and non-conductive materials (e.g., FR-4 material). The base 110 provides electrical paths connecting the components inside the housing interior 122 to components/devices outside of the housing. In particular, an inner surface 114 of the base 110 may include etched portions of conductive material to define lead pads, bond pads, ground pads, etc. that can be electrically connected to the MEMS element 130 and the integrated circuit 140 via wirebond connections 138. These conductive pads are electrically connected to conductive vias (not shown in the present figures) extending through the base 110. The vias are holes that can be drilled through the base 110 and filled or plated with a conductive material. The vias are electrically connected to connection areas (not shown in the present figures) formed on an outer surface 116 of the base 110. The connections areas may be customer pads for electrical connection to an external board of an end-user device. For example, if the microphone device 100 is deployed in a smartphone, the connection areas are electrically coupled to a motherboard of the smartphone. It shall be understood that various fabrication approaches can be used to construct the base 110 and various electrical paths can be formed with the base 110.

The port 112 is formed in the base 110 for receiving acoustic waves. The port 112 can be in the shape of circle, oval, rectangle, etc. In some embodiments, a mesh covers the port 112 for preventing water, particles, and/or light from entering the front volume 124.

The cover 120 may be a one-piece cup-shaped can made of pre-molded metal or plastic. In other embodiments, the cover 120 includes a wall and a flat top over the wall. In some embodiments, the cover 120 includes multiple layers, such as one or more plastic, ceramic, and/or metal layers. The cover 120 may have an internal metal coating that provides an electromagnetic shield (e.g., Faraday cage), that prevents disturbance of the MEMS element 130 and/or integrated circuit 140 from external electromagnetic signals. The cover 120 is attached to the base 110 and forms the housing interior 122 with the base 110. In particular, a peripheral edge of the cover 120 may be fastened to the base 110 by adhesive, solder, and so on, thus forming a hermetical and acoustic seal.

The MEMS element 130 is attached to the inner surface 114 of the base 110 and disposed on top of the port 112. The MEMS element 130 includes a diaphragm 132, a backplate 134 opposing the diaphragm 132, and a MEMS substrate 136 supporting the diaphragm 132 and the backplate 134. In some embodiments, the MEMS element 130 can include more than one backplates. For example, the MEMS element 130 can include dual backplates. In some embodiments, the diaphragm 132 is located between the backplates. In other embodiments, the backplate 134 can be split into two or more backplates. In yet other embodiments, a single backplate is used with multiple diaphragms. For example, a backplate can be located between two diaphragms.

The MEMS substrate 136 can be made of a semiconductor material (e.g., silicon) and attached to the inner surface 114 of the base 110 by, for example, adhesive. In some embodiments, the diaphragm 132 is a "free plate" diaphragm not secured to the MEMS substrate 136. For example, the diaphragm 132 is connected to the MEMS substrate 136 by an approximately 10 μm wide "runner" and is free to move within the space where it is disposed. In other embodiments, movement of the diaphragm 132 is constrained by some constraining elements provided around the periphery of the diaphragm 132. In yet other embodiments, the diaphragm 132 is anchored at the periphery or certain regions of the periphery to the MEMS substrate 136 and the central portion can move or bend in response to pressure exerted by acoustic waves (e.g., sound). The backplate 134 is rigid and held by the MEMS substrate 136. The diaphragm 132 and the backplate 134 include conductive material and collectively form a capacitor. The capacitance varies as the distance between the diaphragm 132 and the backplate 134 changes due to the movement of the diaphragm 132 caused by acoustic waves, thus producing electrical signals (e.g., voltage) that can be sensed.

In operation, sound enters a front volume 124 enclosed by the MEMS element 130 and the base 110 through the port 112. The acoustic waves move the diaphragm 132 and electrical signals are produced reflecting the capacitance change between the diaphragm 132 and the backplate 134. The available space in the housing interior 122 forms the back volume for the MEMS element 130. In some embodiments, through hole(s) are made on the diaphragm 132 to enable equalization of the static pressure on both sides of the diaphragm 132. In other embodiments, the diaphragm 132 is not pierced such that the diaphragm 132 does not include any through holes. In some embodiments, a plurality of perforations are formed on the backplate 134 to enable ventilation or free circulation of air between the backplate 134 and the diaphragm 132. In further embodiments, there is path (air leakage path) between the diaphragm 132 and the MEMS substrate 136 and/or in the MEMS substrate 136 for air to circulate between the front volume 124 and the housing interior 122.

The integrated circuit 140 is mounted on top of the MEMS element 130 and at least partly covers the MEMS element 130. In some embodiments, the integrated circuit 140 is an application specific integrated circuit (ASIC) fabricated on a semiconductor die. The integrated circuit 140 can include an active surface 142 and a substrate 144 can support the active surface 142. Circuitry and/or connectors can be formed on the active surface 142 for processing electrical signals produced by the MEMS element 130. For some integrated circuits 140, it is beneficial to shield the active surface 142 from light. The integrated circuit can be configured to carry out operations such as amplification, filtering, processing, etc., to the electrical signals produced by the MEMS element 130 and generate an output that can be used by, for example, an end-user device. The processing operations by the integrated circuit can include analog and/or digital signal processing functions. The substrate 144 can be formed of a semiconductor material (e.g., silicon). As shown in FIG. 1, the substrate 144 faces the MEMS element 130, leaving the active surface 142 at a far end relative to the MEMS element 130. This arrangement allows minimal exposure of the active surface 142 to light that might pass through the MEMS element 130. In further embodiments, the integrated circuit 140 includes a layer of encapsulant 148 covering the active surface 142 for protecting the integrated circuit. The encapsulant 148 can be made of resin, epoxy, polyimide, etc.

In various embodiments, the integrated circuit 140 is stacked on top of the MEMS element 130 and secured to the MEMs element 130 through solder bumps 131. In some embodiments, the solder bumps 131 are formed of metal and have a spherical shape with a diameter of about 100 μm. It shall be understood that solder bumps can be of any appropriate shape and dimension. Besides mechanical support to the integrated circuit 140, the solder bumps 131 provide an electrical connection between the integrated circuit 140 and the MEMS element 130. In particular, the solder bumps 131 are attached to bond pads on the MEMS element 130 at one end and to conductive vias 146 formed within the substrate 144 at the other end. The conductive vias 146 are through holes formed within the substrate 144 of the integrated circuit 140 that are filled or plated with a conductive material. The conductive vias 146 are electrically connected to the active surface 142. The solder bumps 131 can also function as spacers allowing air flow from the movement of the diaphragm 132 to vent into the housing interior 122.

In some embodiments, in addition to the solder bumps 131, the MEMS element 130 is electrically connected to the integrated circuit 140 through wire bonding 133 between bond pads on the MEMS element 130 and corresponding pads on the integrated circuit 140. In further embodiments, the wire bonding 133 is used for high impedance connections, such as transmitting electrical signals produced by the MEMS element 130 to the integrated circuit 140 for processing. The solder bumps 131 can be used for low impedance connections, such as supplying power and providing ground to the integrated circuit 140, and outputting processed signals from the integrated circuit 140.

In some embodiments, the MEMS element 130 is electrically connected to the base 110 through wire bonding 138 between bond pads on the MEMS 130 and corresponding pads on the base 110. The output of the integrated circuit 140 can be transmitted through the solder bumps 131, through the wire bonding 138, then through the conductive vias extending through the base 110 and the connections areas on the outer surface 116 of the base 110, to the external device, as discussed above regarding electrical connections of the base 110. It shall be understood that this is for illustration and not for limiting; various approaches can be used to make electrical connections between the integrated circuit 140 and the external device for outputting the processed signals.

Comparing to the arrangement in which the MEMS element and the integrated circuit are placed side-by-side in a package, the arrangement as shown in FIG. 1 in which the integrated circuit is stacked on the MEMS element can reduce the lateral space inside the package, thereby reducing the footprint of the package. In addition, since the substrate of the integrated circuit faces the MEMS element, the active surface of the integrated circuit is protected from exposure to light that might pass through the MEMS element.

Figure 2:
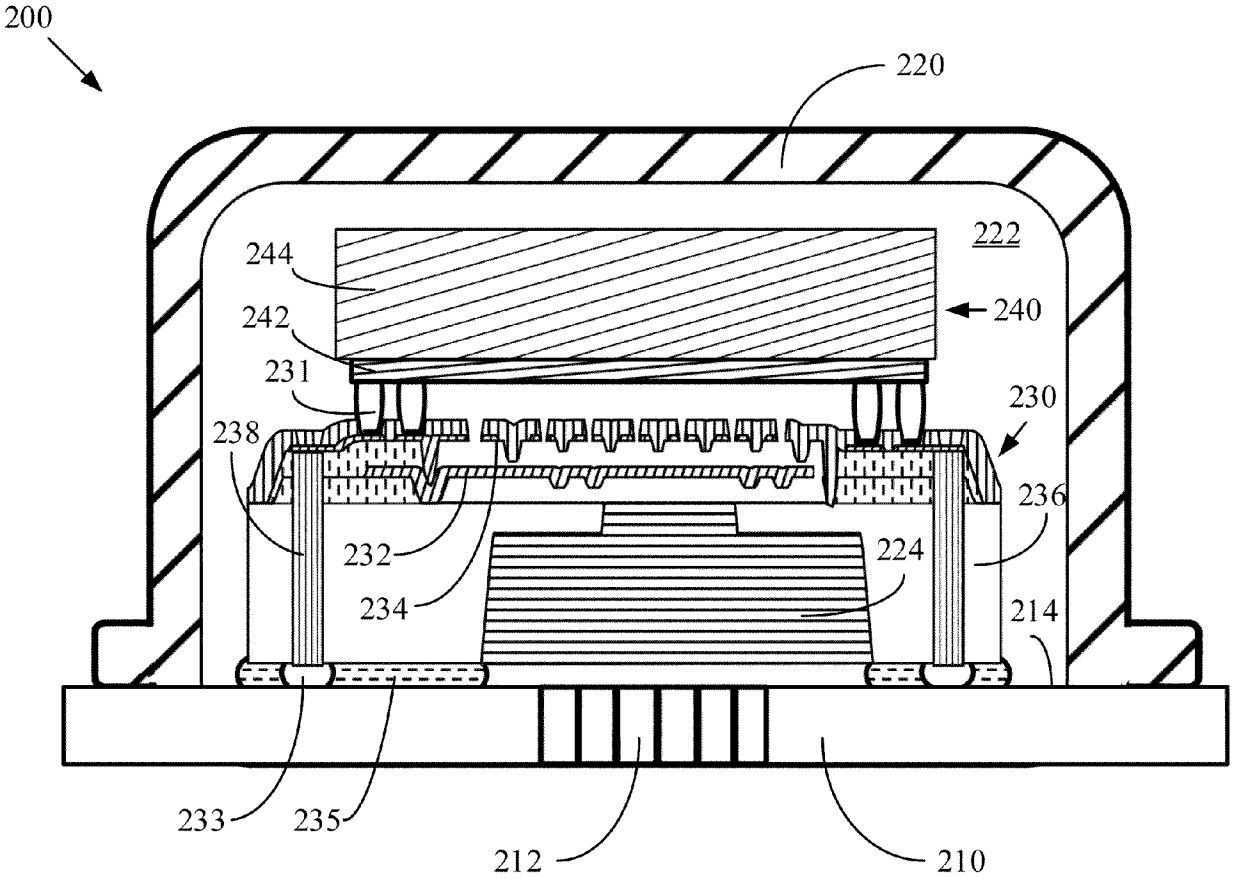
FIG. 2 is a schematic cross-sectional diagram of a stacked chip microphone device in accordance with a second embodiment.

Referring to FIG. 2, a schematic cross-sectional diagram of a stacked chip microphone device is shown in accordance with a second embodiment. The microphone device 200 includes a base 210, a cover (or lid) 220, a MEMS element 230, and an integrated circuit 240. The cover 220 is attached to the base 210 and forms a housing interior 222 with the base 210. A port 212 is formed in the base 210, allowing sound to enter a front volume 224. The microphone element 230 is disposed within the housing interior 222 and attached to the base 210 through first solder bumps 233. The integrated circuit 240 is stacked on top of the MEMS element 230 through second solder bumps 231. Different than the microphone device 100 shown in FIG. 1 in which wire bonding is used for making some electrical connections, wire bonding is eliminated from the microphone device 200.

The base 210, the port 212, and the cover 220 may have similar structure as the base 110, the port 112, and the cover 120 shown in FIG. 1, respectively. The MEMS element 230 is attached to the inner surface 214 of the base 210 through the first solder bumps 233. In some embodiments, a layer of die attach or underfill 235 (e.g., adhesive) surrounds the first solder bumps 233 and acoustically seals the MEMS element 230 to the base 210. The first solder bumps 233 also provide electrical connections between the base 210 and the MEMS element 230. In particular, the first solder bumps 230 are attached to bond pads on the base 210 at one end and to conductive vias 238 formed within the MEMS element 230 at the other end. The conductive vias 238 are through holes formed within the MEMS element 230 that are filled or plated with a conductive material. The MEMS element 230 includes a diaphragm 232, a backplate 234 opposite to the diaphragm 232, and a MEMS substrate 236 supporting the diaphragm 232 and the backplate 234. The diaphragm 232, the backplate 234, and the MEMS substrate 236 may have similar structure as the diaphragm 132, the backplate 134, and the MEMS substrate 136 shown in FIG. 1, respectively.

The integrated circuit 240 is mounted on top of the MEMS element 230 through second solder bumps 231. In some embodiments, the integrated circuit 240 is an ASIC. The integrated circuit 240 includes an active surface 242 and a substrate 244 supporting the active surface 242. Circuitry and/or connectors can be formed on the active surface 242 for processing electrical signals produced by the MEMS element 230. In some embodiments, the integrated circuit 240 is stacked on top of the MEMS element 230 in a flip chip configuration. As used herein, a flip chip configuration means that the active surface 242 of the integrated circuit 240 is bonded directly to the MEMS element 230 through the second solder bumps 231. This arrangement in which the active surface 242 faces the MEMS element 230 can be used if the integrated circuit on the active surface 242 is rendered not light sensitive. The encapsulant layer is unnecessary in this arrangement since the active surface 242 is located between the MEMS element 231 and the substrate 244 and connection is made via solder bumps 231 instead of wire-bond wires like 133. The second solder bumps 231 provide electrical connections between the integrated circuit 240 and the MEMS element 230. In particular, the second solder bumps 231 are attached to bond pads on the MEMS element 230 at one end and to corresponding bond pads on the active surface 242 of the integrated circuit 240 at the other end. The second solder bumps 231 can also function as spacers allowing air flow from the movement of the diaphragm 232 to vent into the housing interior 222. No wire bonding is used to electrically connect the integrated circuit 240 to the MEMS element 230. The second solder bumps 231 are used for both high impedance connections and low impedance connections.

In operation, sound enters the front volume 224 enclosed by the MEMS element 230 and the base 210 through the port 212. The acoustic waves move the diaphragm 232 and electrical signals are produced reflecting the capacitance change between the diaphragm 232 and the backplate 234. The electrical signals are transmitted to the integrated circuit 240 for processing through one or more of the second solder bumps 231. The output of the integrated circuit 240 can be transmitted through one or more of the second solder bumps 231, through the conductive vias 238 within the MEMS element 230, then through the conductive vias extending through the base 210 and the connections areas on the outer surface 216 of the base 210, to the external device.

Since the integrated circuit is stacked on the MEMS element in a flip chip configuration, the lateral space inside the package can be reduced, and the encapsulant layer can be omitted. In addition, since no wire bonding is used on the MEMS element and the integrated circuit, a larger area can be used for active components of the MEMS element and the integrated circuit for a given desired footprint of the microphone. Reducing the lateral space used by the microphone devices allows for smaller devices compared to devices where the MEMS element and the integrated circuit are located side-by-side.

Figure 3:
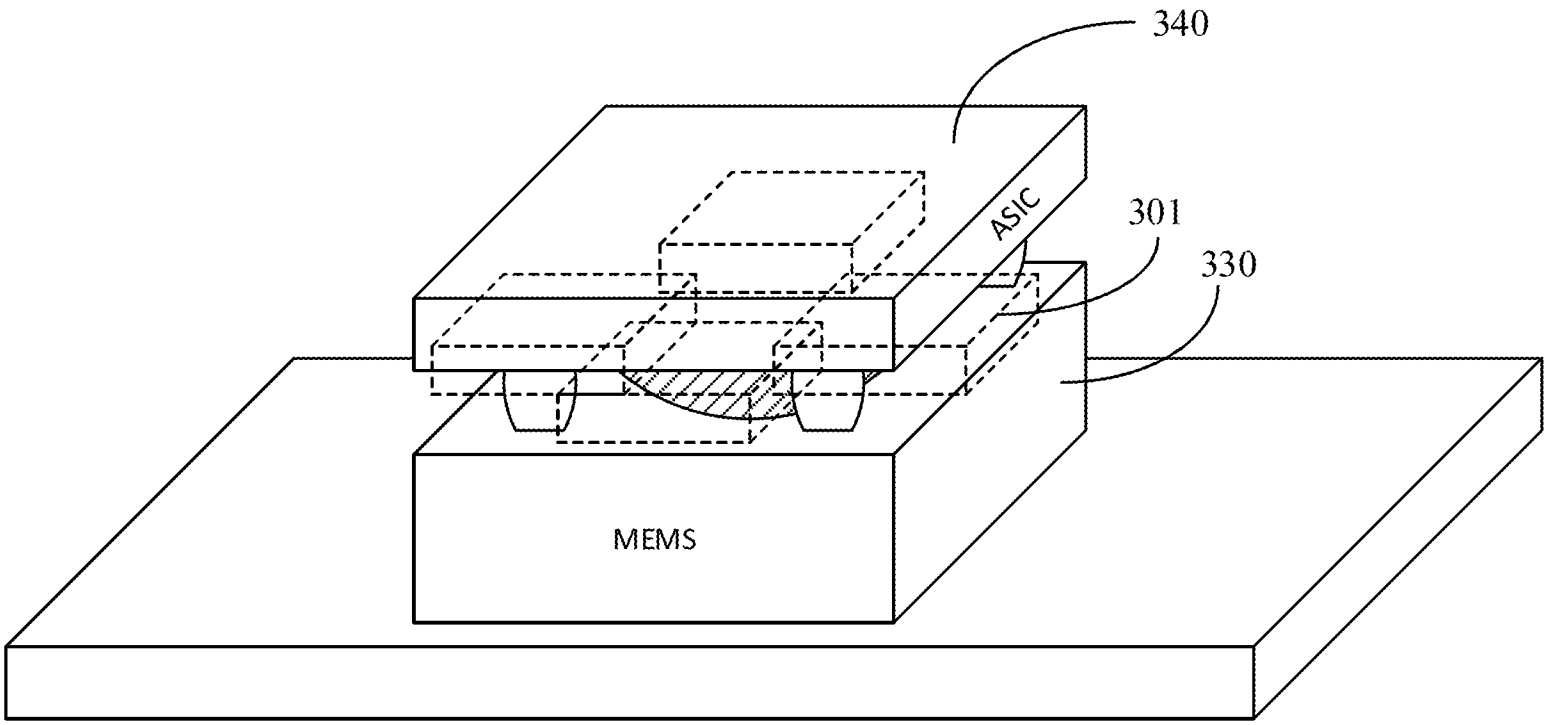
FIG. 3 is a schematic diagram of a model of a stacked chip microphone device used for simulations in accordance with various embodiments.

The various described embodiments, however, have similar performances as known side-by-side devices. FIG. 3 shows a model of a stacked chip microphone device used for simulations. A simulation was used to calculate the frequency response and the noise level. In the calculation, a series of slots (shown by dotted lines) were used to simulate the opening 301 between the MEMS element 330 and the stacked ASIC chip 340. The height of the opening 301 was set as 50 μm.

Figure 4A:
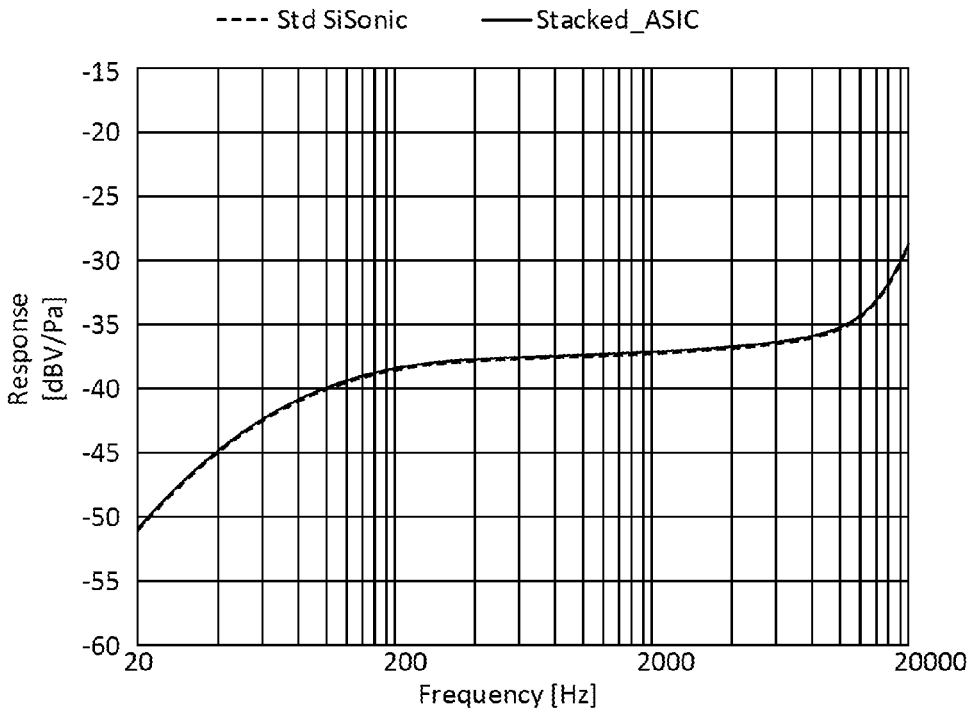
FIG. 4A is a graph of simulated frequency responses for a side-by-side MEMS microphone device and a stacked chip microphone device.

FIG. 4A is a graph of simulated frequency responses for a MEMS microphone device in which the MEMS element and the ASIC are placed side-by-side (e.g., a SiSonic® microphone) and a stacked chip microphone device. The frequency response indicates the sensitivity of the microphone device as a function of frequency. The solid line represents the frequency response of the stacked chip microphone device across a frequency range from 20 Hz to 20,000 Hz. The dotted line represents the frequency response of the microphone device with side-by-side arrangement across the same frequency range. The two lines substantially coincide with each other, which indicates that the sensitivity of the microphone device is not impacted by the stacked chip arrangement.

Figure 4B:
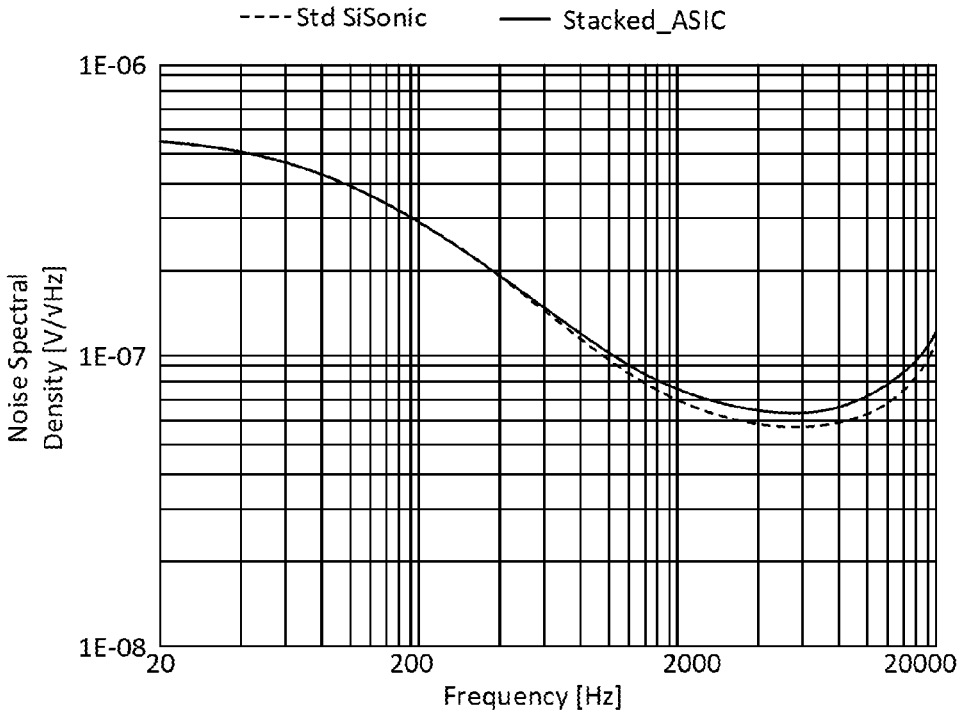
FIG. 4B is a graph of simulated noise spectra for a side-by-side MEMS microphone device and a stacked chip microphone device.

FIG. 4B is a graph of simulated noise spectra for a MEMS microphone device with side-by-side arrangement (e.g., a SiSonic® microphone) and a stacked chip microphone device. The solid line represents the noise spectral density of the stacked chip microphone device across a frequency range from 20 Hz to 20,000 Hz. The dotted line represents the noise spectral density of the microphone device with side-by-side arrangement across the same frequency range. The noise spectral density indicates the noise level of the microphone device. The net drop in the signal-to-noise-ratio (SNR) of the stacked chip microphone device comparing to the side-by side arrangement is about 1 dB (from 64.2 dB-A to 63.3 dB-A). Thus, the noise penalty is substantially negligible. Further, with wider openings between the MEMS element and the integrated circuit, i.e., greater solder bump height, the noise penalty can be reduced more.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A microphone device comprising:

a base;

a port formed in the base;

a cover attached to the base that forms a housing interior with the base;

a micro-electro-mechanical system (MEMS) element disposed in the housing interior and on top of the port, wherein the MEMS element includes a diaphragm and a backplate opposing the diaphragm;

an integrated circuit stacked on top of the MEMS element, wherein the integrated circuit includes an active surface and a substrate supporting the active surface, wherein the active surface comprises circuitry for processing signals produced by the MEMS element, wherein the substrate is between the MEMS element and the active surface; and solder bumps forming a connection between the MEMS element and the integrated circuit, the solder bumps forming air gaps between the MEMS element, the integrated circuit, and the solder bumps through which air flows from the MEMS element to a back volume of the microphone device.

2. The microphone device of claim 1, wherein the integrated circuit is an application specific integrated circuit (ASIC).

3. The microphone device of claim 1, wherein the solder bumps are substantially spherical with a diameter of about 100 μm.

4. The microphone device of claim 1, wherein the integrated circuit further comprises conductive vias extending therethrough that electrically connect the solder bumps to the active surface.

5. The microphone device of claim 1, wherein the solder bumps provide low impedance connections between the MEMS element and the integrated circuit.

6. The microphone device of claim 5, wherein the low impedance connections include a power supply input and a ground to the integrated circuit.

7. The microphone device of claim 6, wherein the low impedance connections further include an output from the integrated circuit.

8. The microphone device of claim 1, further comprising wire bonding that electrically connects the MEMS element to the integrated circuit.

9. The microphone device of claim 8, wherein the wire bonding provides high impedance connections between the MEMS element and the integrated circuit.

10. The microphone device of claim 9, wherein the high impedance connections are configured to transmit electrical signals produced by the MEMS element to the integrated circuit.

11. A microphone device comprising:

a base;

a port formed in the base;

a cover attached to the base that forms a housing interior with the base;

a micro-electro-mechanical system (MEMS) element disposed in the housing interior and on top of the port, wherein the MEMS element includes a diaphragm and a backplate opposing the diaphragm, and wherein the MEMS element is attached to the base through first solder bumps; and an integrated circuit stacked on top of the MEMS element through second solder bumps, the second solder bumps forming air gaps between the MEMS element, the integrated circuit, and the second solder bumps through which air flows from the MEMS element to a back volume of the microphone device.

12. The microphone device of claim 11, wherein the integrated circuit is an application specific integrated circuit (ASIC).

13. The microphone device of claim 11, wherein the integrated circuit includes an active surface and a substrate supporting the active surface, wherein the active surface comprises circuitry for processing signals produced by the MEMS element, and wherein the active surface is between the MEMS element and the substrate.

14. The microphone device of claim 11, further comprising a layer of die attach or underfill surrounding the first solder bumps that acoustically seals the MEMS element to the base.

15. The microphone device of claim 11, wherein the MEMS element further comprises conductive vias extending therethrough that electrically connect the MEMS element to the first solder bumps.

16. The microphone device of claim 15, wherein the conductive vias electrically connect the MEMS element to the integrated circuit via the second solder bumps.

* * * * *